US011125153B2

(12) United States Patent
Alves De Moraes et al.

(10) Patent No.: US 11,125,153 B2
(45) Date of Patent: Sep. 21, 2021

(54) ENGINE VALVE CLEANING SYSTEM

(71) Applicant: Robert Bosch GmbH, Stuttgart (DE)

(72) Inventors: Marcelo Alves De Moraes, Apple Valley, MN (US); Corey Schlichter, Faribault, MN (US)

(73) Assignee: ROBERT BOSCH GMBH, Stuttgart (DE)

( * ) Notice: Subject to any disclaimer, the term of this patent is extended or adjusted under 35 U.S.C. 154(b) by 172 days.

(21) Appl. No.: 16/724,103

(22) Filed: Dec. 20, 2019

(65) Prior Publication Data

US 2021/0189955 A1 Jun. 24, 2021

(51) Int. Cl.
*F02B 77/04* (2006.01)
*B24C 9/00* (2006.01)

(52) U.S. Cl.
CPC ..... *F02B 77/04* (2013.01); *B24C 9/00* (2013.01)

(58) Field of Classification Search
CPC ..... F02B 77/04; B24C 9/00; B24C 9/006
See application file for complete search history.

(56) References Cited

U.S. PATENT DOCUMENTS 1,903,016 A * 3/1933 Thomas ..... F02B 77/04 134/169 R
2017/0248075 A1* 8/2017 Nemeth ..... F02B 77/04

FOREIGN PATENT DOCUMENTS

GB 522527 A * 6/1940 ..... F02B 77/04

OTHER PUBLICATIONS

Website: https://www.ecstuning.com/b-genuine-bmw-parts/carbon-blaster-tool/81292208034/?gclid=CjwKCAjwm-fkBRBBEiwA966fZIIPIiRJFjWoSNpwKEmlv2AFk51hmedSQWwgZfmw1Ig3VwNCBo6yjxoCZj8QAvD_BwE.
Website: https://www.northerntool.com/shop/tools/product_200693483_200693483.

* cited by examiner

*Primary Examiner* — Hung Q Nguyen
(74) *Attorney, Agent, or Firm* — Dickinson Wright PLLC

(57) ABSTRACT

An engine valve cleaning system is disclosed. The system includes a first tube configured to deliver pressurized air, a second tube configured couple to an abrasive media source and draw an abrasive media therefrom, and a spray applicator. The spray applicator includes a first passageway coupled to the first tube and configured to deliver pressurized air, and a second passageway coupled to the second tube and configured to deliver the abrasive media. The first passageway intersects the second passageway such that a passing of the pressurized air past the second passageway draws the abrasive media from the abrasive media source without the necessary for an external vacuum. A third passageway is downstream of the first and second passageways and configured to output the pressurized air and abrasive media to an engine.

20 Claims, 6 Drawing Sheets

ENGINE VALVE CLEANING SYSTEM

TECHNICAL FIELD

The present disclosure relates to an engine intake valve cleaner, and associated systems and method for cleaning an intake valve of an engine, exemplified in various embodiments described herein.

BACKGROUND

Carbon and soot deposits can accumulate within internal combustion engines, typically after prolonged use of the engine. Such deposits may be undesirable and may degrade the performance of the engine if left untreated. For example, if significant amounts of carbon and soot deposits coalesce at an intake valve of an engine cylinder, the deposits can interfere with operation of the valve.

Various chemical treatments are typically utilized to remove the carbon and soot deposits and buildup within engines. For example, a liquid application of various chemicals (e.g., glycol ethers, aryl alcohol, etc.) may be applied to the cylinders of the engine. The engine components may soak in the liquid, allowing the chemical composition of the liquid to chemically react with the carbon and soot deposits to remove such deposits from the metal surfaces of the engine. This can be a lengthy process, with 30 minutes or more being necessary for soak time per engine cylinder. Some chemical applications recommend an overnight soak.

SUMMARY

In one embodiment, an engine valve cleaning system includes a first tube configured to deliver pressurized air; a second tube configured couple to an abrasive media source and draw an abrasive media therefrom; and a spray applicator. The spray applicator includes a first passageway coupled to the first tube and configured to deliver pressurized air, a second passageway coupled to the second tube and configured to deliver the abrasive media, wherein the first passageway intersects the second passageway such that a passing of the pressurized air past the second passageway is configured to draw the abrasive media from the abrasive media source, and a third passageway downstream of the first and second passageways and configured to output the pressurized air and abrasive media to an engine.

In another embodiment, an engine valve cleaning system includes a first tank containing an abrasive media; a first tube having a first end connected to the first tank, and a second end connected to a spray applicator; a second tube connected to the spray applicator and configured to supply pressurized air to the spray applicator; a universal adapter configured to connect to an opening of an engine head, wherein the universal adapter has: an inlet extending therethrough and configured to receive the spray applicator for spraying the pressurized air and abrasive media into the engine head, and an outlet configured to outlet the pressurized air and the abrasive media subsequent to the spraying of the pressurized air and abrasive media. The system also includes a third tube connected to the outlet of the universal adapter and configured to deliver the pressurized air and abrasive media output from the outlet into a second tank.

In yet another embodiment, a method of removing carbon deposits from surfaces of an engine head is provided. The method includes placing an adapter above an opening of an engine head; inserting a spray gun into a first opening of the adapter and into the engine head; and activating a spray applicator to cause pressurized air and an abrasive media to spray onto surfaces within the engine head, wherein the pressurized air and abrasive media exits the adapter via a second opening of the adapter and into a tank.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

This disclosure is not limited to the specific embodiments and methods described below, as specific components and/or conditions may, of course, vary. Furthermore, the terminology used herein is used only for the purpose of describing embodiments of this disclosure and is not intended to be limiting in any way unless noted.

As used in the specification and the appended claims, the singular form "a," "an," and "the" comprise plural referents unless the context clearly indicates otherwise. Reference to a component in the singular is intended to comprise a plurality of components, unless the context clearly indicates otherwise.

Carbon and soot deposits (herein after generally referred to as carbon deposits) accumulate within internal combustion engines, typically after prolonged use of the engine. If left untreated, carbon deposits may degrade the performance of the engine. For example, an intake valve of an engine cylinder may have operational issues if there the significant carbon deposits located thereon. While various chemical treatments have been implemented to reduce or remove carbon deposits, these processes can be lengthy in time.

Therefore, according to various embodiments described herein, an engine valve cleaning system is disclosed. The engine valve cleaning system allows pressurized air and an optional media (e.g., sand) to blast into the engine head, removing the carbon deposits therefrom. This procedure can take as little as a minute complete for each engine cylinder, saving the consumer valuable time.

Figure 1:
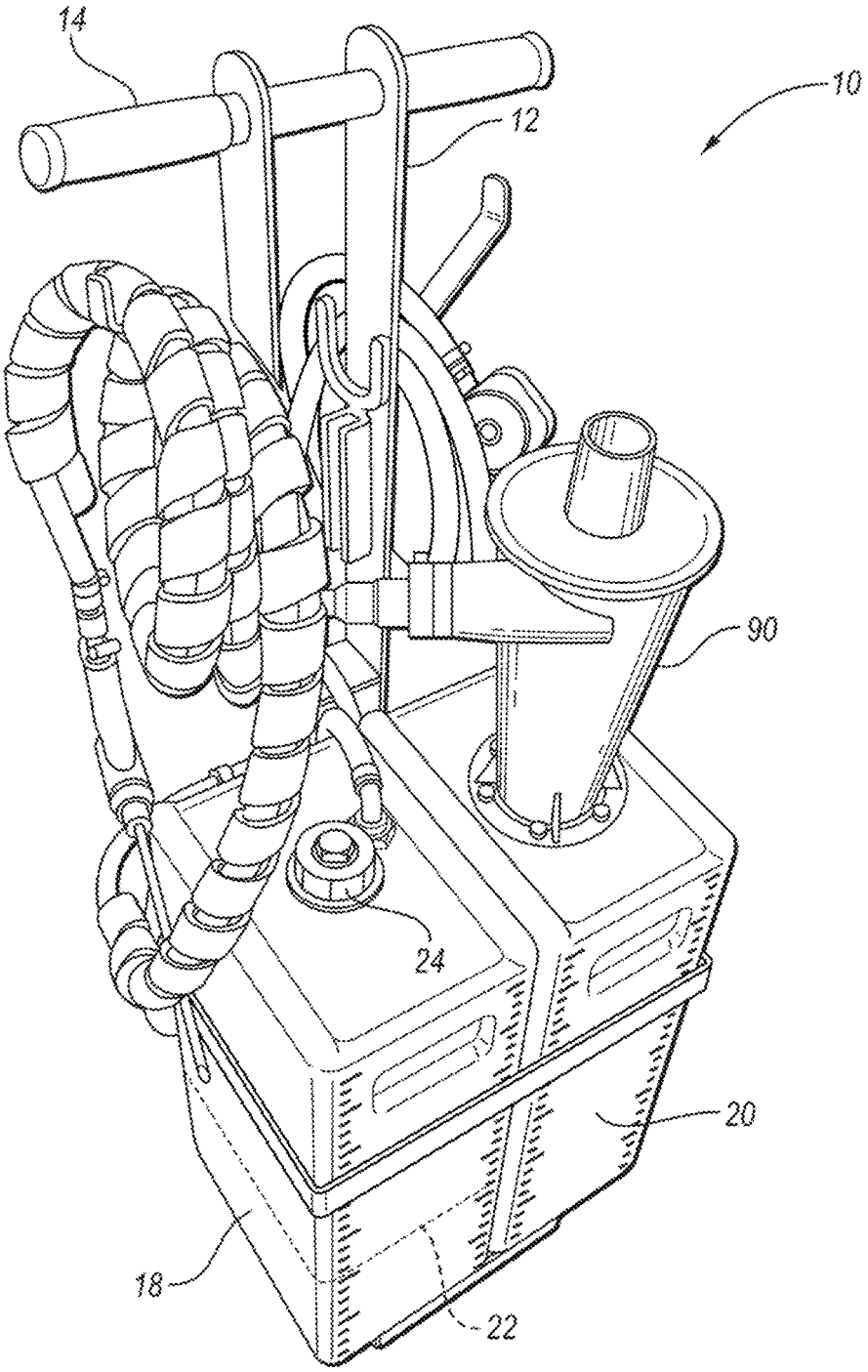
FIG. 1 is a front perspective view of an engine valve cleaning system, according to one embodiment.
Figure 2:
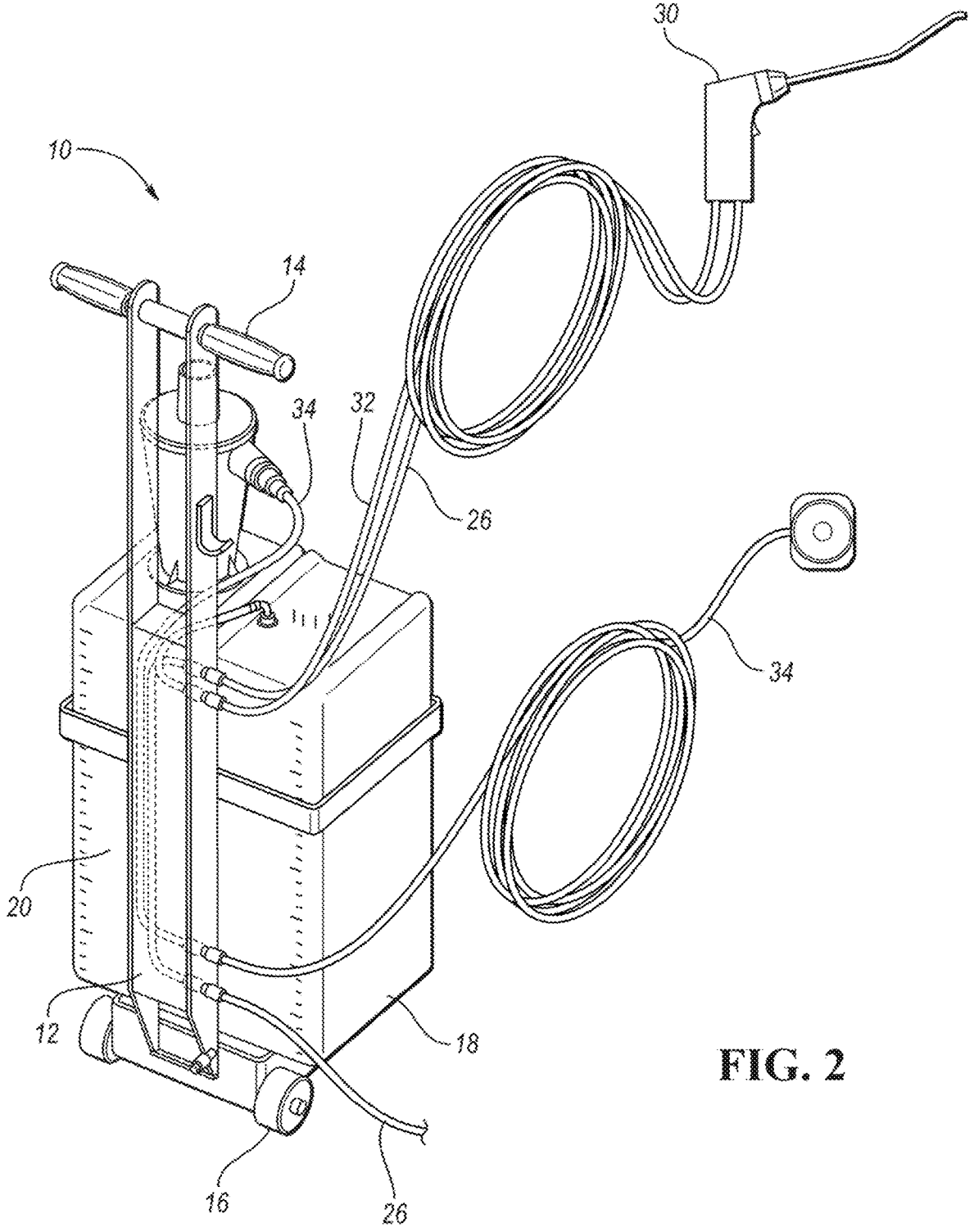
FIG. 2 is a rear perspective view of the engine valve cleaning system, according to one embodiment.

Referring to FIGS. 1-2, one embodiment of an engine valve cleaning system 10 is illustrated. The engine valve cleaning system 10 includes a frame 12. The frame 12 can have one or more handles 14 and one or more wheels 16 to enable the system 10 to be easily transported about a service location, such as an auto repair garage. The frame 12 supports a first tank 18 and a second tank 20. The tanks 18, 20 may be strapped or otherwise secured to the frame.

The first tank 18, also referred to as a new media tank, is configured to store an abrasive media 22 for spraying into the engine head. The first tank 18 is therefore one embodiment of a source of the abrasive media 22. The abrasive media 22 may be a solid material, such as a granule, grit, or other small course material. In one embodiment, the abrasive media is sand. Other examples of abrasive media include aluminum oxide grit, silicon carbide grit, glass beads, steel shot, walnut shells media, and the like. The first tank 18 includes an inlet 24 for filling the first tank 18 with the abrasive media 22.

The second tank 20, also referred to as a dirty media tank, is configured to receive the abrasive media 22 after use of cleaning on the engine head, along with any carbon deposits that are cleaned off the surfaces of the engine. Once the second tank 20 is filled with the dirty abrasive media and carbon deposits from the engine, the second tank 20 may be removed from the frame 12 and emptied in an appropriate disposal.

Figure 3:
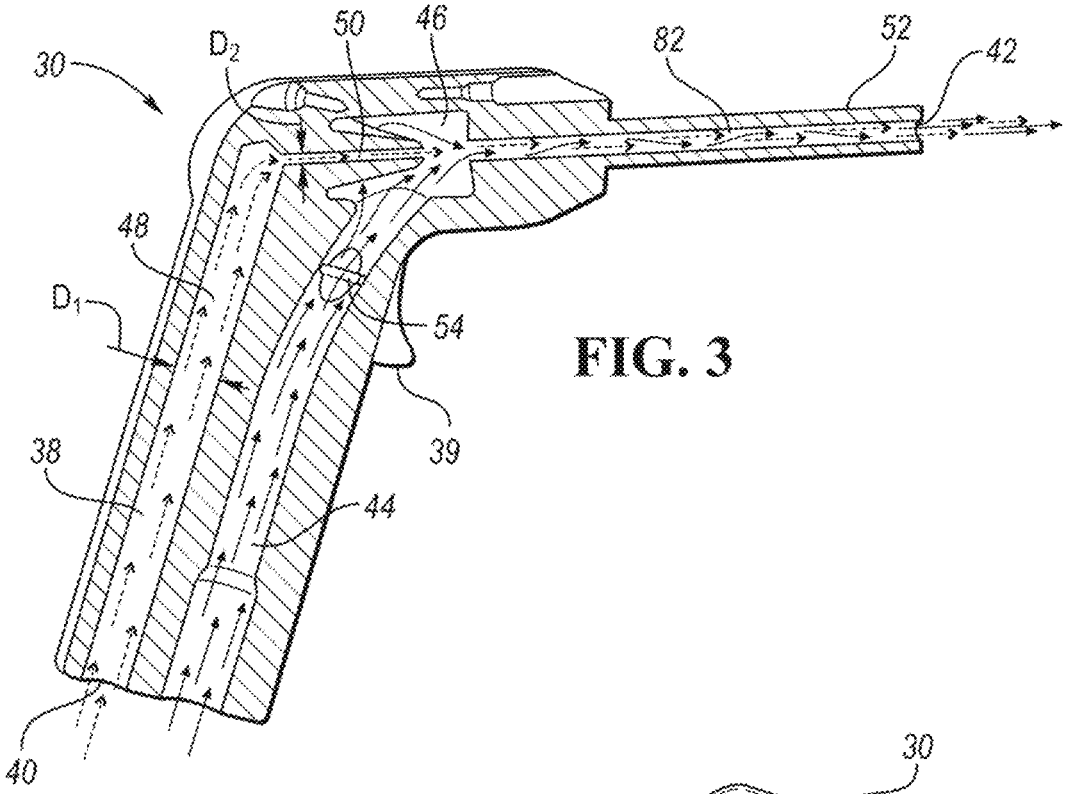
FIG. 3 is a cross-sectional view of a spray applicator for spraying air and an abrasive media into an engine head to clean surfaces therein, according to one embodiment.

The engine valve cleaning system 10 has several tubes. For example, a first tube 26, also referred to as an air tube, is configured to supply pressurized air from a source of pressurized or compressed air (e.g., a compressor). The first tube 26 extends from the source of pressurized air and to a spray applicator 30. The spray applicator 30, which will be described further with reference to FIG. 3, is an air gun configured to spray the pressurized air into a desired location within the engine head. A second tube 32, also referred to as a media tube, is configured to deliver the abrasive media 22 from the first tank 18 and into the spray applicator 30. The second tube 32 has a first end coupled to the first tank 18, and a second end coupled to the spray applicator 30. A third tube 34, also referred to as an adapter tube, is coupled to a universal adapter (explained further below) 58 downstream of the engine head. The abrasive media 22, along with the pressurized air and any carbon deposits removed from the surfaces of the engine head, travel through the third tube and into the second tank 20. Each tube 26, 32, 34 may extend through a respective aperture 36 within the frame 12 for properly locating, storing, and organizing the tubes. In another embodiment, instead of apertures, the frame 12 is provided with clips or other fasteners to properly secure the tubes 26, 32, 34 onto the frame 12.

Referring to FIG. 3, a cross-sectional view of the spray applicator 30 is shown. The spray applicator 30 has a handheld, ergonomic design allowing a user to easily grip and manipulate the spray applicator 30 with one hand. The spray applicator 30 has a first passageway 38 defined therein. The first passageway 38 is coupled to the first tube 26 for delivering the pressurized air. A trigger 39 may be provided for selectively allowing the pressurized air to exit the spray applicator 30, thereby spraying the pressurized air. The first passageway 38 extends from a first end 40 at one end of the spray applicator 30, to a second end 42 at another end of the spray applicator 30. The first end 40 is coupled to the first tube 26. The second end 42 is at an exit of a nozzle 52 of the spray applicator.

The spray applicator 30 has a second passageway 44 defined therein. The second passageway 44 is coupled to the second tube 32 for delivering the abrasive media 22. The second passageway 44 leads the abrasive media 22 into a pocket 46 that radially surrounds the first passageway 38. The second passageway 44 intersects the first passageway 38 at the pocket 46 to allow the abrasive media 22 to mix with the pressurized air.

The abrasive media 22 is drawn into interaction with the pressurized air at the intersection between the first passageway 38 and the second passageway 44. This is made possible, according to one embodiment, via a venturi effect as the pressurized air from the first passageway 38 passes across the second passageway 44. In particular, the first passageway 38 may have a first portion 48 having a first diameter $D_1$, and a second portion 50 having a second diameter $D_2$. The second diameter $D_2$ is smaller than the first diameter $D_1$. In one embodiment, the second diameter is less than half of the first diameter. This change in diameter causes the static air pressure in in the first portion 48 to be higher than at the portion 50, and the fluid air speed at the first portion 48 is lower than the fluid air speed at the second portion 50. The reduction in air pressure in the second portion 50 draws the abrasive media 22 from the second passageway 44, and into the intersection between the second passageway 44 and the first passageway 38. The abrasive media 22 is then sent out of the nozzle 52 of the spray applicator 30 along with the pressurized air.

The change of air pressure in the spray applicator 30 draws the abrasive media 22 out without requiring a separate vacuum or pump to perform this function. In other words, by using the spray applicator 30 described herein, the only source of power to operate the engine valve cleaning system 10 is the source of pressurized air, and no additional sources of power necessary to discharge the abrasive media 22 from the first tank 18.

The spray applicator 30 may also have a valve 54. The valve 54 is in communication with (e.g., at least partially disposed within) the second passageway 44 and is configured to control the amount of abrasive media 22 interacting with the pressurized air. The valve 54 may be located at an underside of the spray applicator 30. The valve 54 may be a globe valve, a gate valve, a butterfly valve, or other suitable types that can control an amount of abrasive media 22 allowed to pass therethrough. Moreover, the valve 54 can be controlled to be fully closed to prevent any abrasive media 22 from interacting with the pressurized air. In such a scenario, only the pressurized air would be applied to the surfaces of the engine head. This may be useful for cleaning the loose debris and abrasive media 22 from the interior of the engine head at the conclusion of cleaning the surfaces of the engine head.

Figure 4:
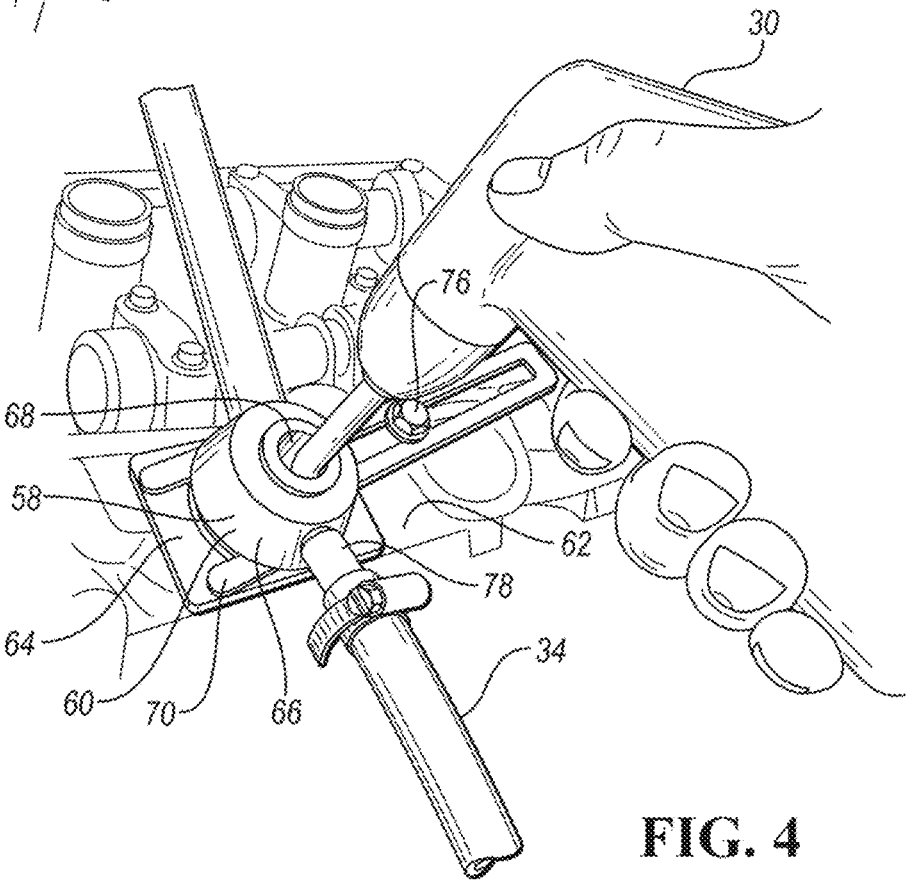
FIG. 4 is a perspective view of a use of the spray applicator with a universal adapter placed over an engine cylinder for removing carbon and/or soot deposits from the engine cylinder, according to one embodiment.
Figure 6:
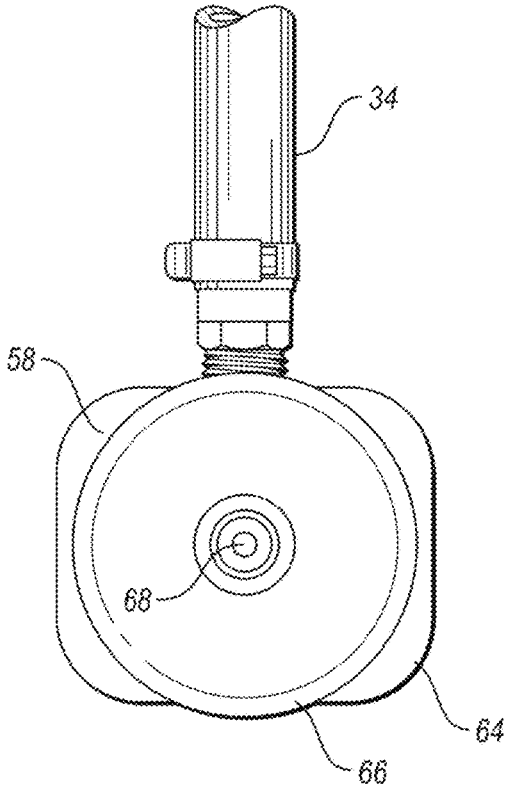
FIG. 6 is an overhead view of a front side of the universal adapter of the engine valve cleaning system, according to one embodiment.
Figure 7:
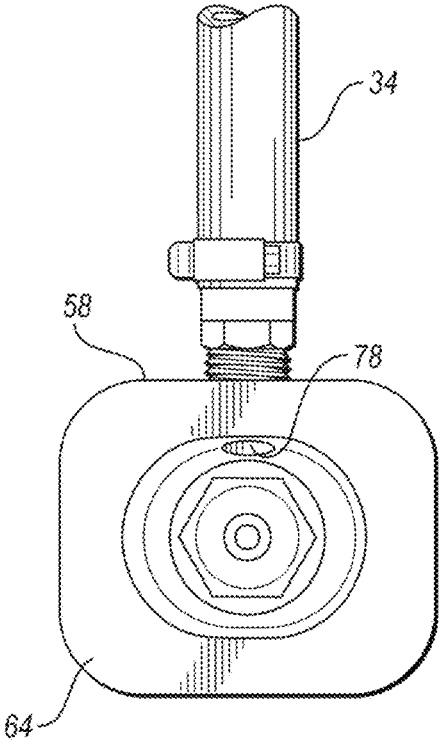
FIG. 7 is an overhead view of a back side (e.g., configured to face and contact the engine) of the universal adapter of FIG. 6, according to one embodiment.

FIG. 4 illustrates use of the spray applicator 30 with a universal adapter 58. The universal adapter is "universal" in that it can couple to many different types and sizes of engine heads. The universal adapter is also shown in isolation in FIGS. 5-7. In one embodiment, the universal adapter 58 has a main body 60 made of a flexible material, such as rubber. The flexibility of the main body 60 allows the main body 60 to form a seal when placed over a cylinder of an engine head, such as the engine head 62 shown in FIG. 4.

The main body 60 may include a generally planar base 64 that extends over one of the cylinders of the engine head 62. A cylindrical or tubular portion 66 may extend upward from the base 64, in a direction away from the engine head 62. The tubular portion 66 may have an aperture 68 extending therethrough and aligned with the cylinder of the engine head. The aperture 68 may extend entirely through the adapter 58. This allows the spray applicator 30 (and, in particular, its nozzle 52) to extend through the adapter 58 and into the cylinder of the engine head 62 for cleaning within the cylinder. Meanwhile, the seal created by the base 64 pressed upon the engine head 62 inhibits carbon deposits and/or the abrasive media 22 from exiting in an uncontrolled manner. The tubular portion 66 may have a flexible or compressible substance (e.g., rubber, foam, etc.) located therein to seal the area surrounding the nozzle 52 as the nozzle 52 is inserted therethrough. This inhibits the carbon deposits and/or abrasive media 22 from exiting the engine head through the tubular portion 66 where the nozzle 52 is inserted.

A head support 70 may also be provided to secure the universal adapter 58 to the engine head 62. The head support 70 is also shown in isolation in FIG. 5. The head support 70 may have a first forked portion 72 open at a first end of the head support 70. The forked portion 72 includes a pair of linear members configured to extend within a gap defined between the tubular portion 66 and the base 64 of the main body 60 of the universal adapter 58, as shown in FIG. 4. The head support 70 can, in other embodiments, connect to other locations of the universal adapter 58.

The head support 70 may also have a second forked portion 74 at a second end of the head support 70. The second forked portion 74 may have a gap between a pair of linear members, in which the gap at the second end is smaller than the gap at the first end. The gap formed at the second forked portion 74 allows for a fastener 76, such as a bolt or screw, to extend therethrough. The fastener 76 may extend through the gap at the second forked portion 74, and into a corresponding receptacle in the engine head 62 that may be already existing in the engine head 62. The second forked portion 74 may also be generally elongated, allowing the fastener 76 to attach to the head support 70 at various positions, depending on the configuration of the particular engine being cleaned.

Figure 5:
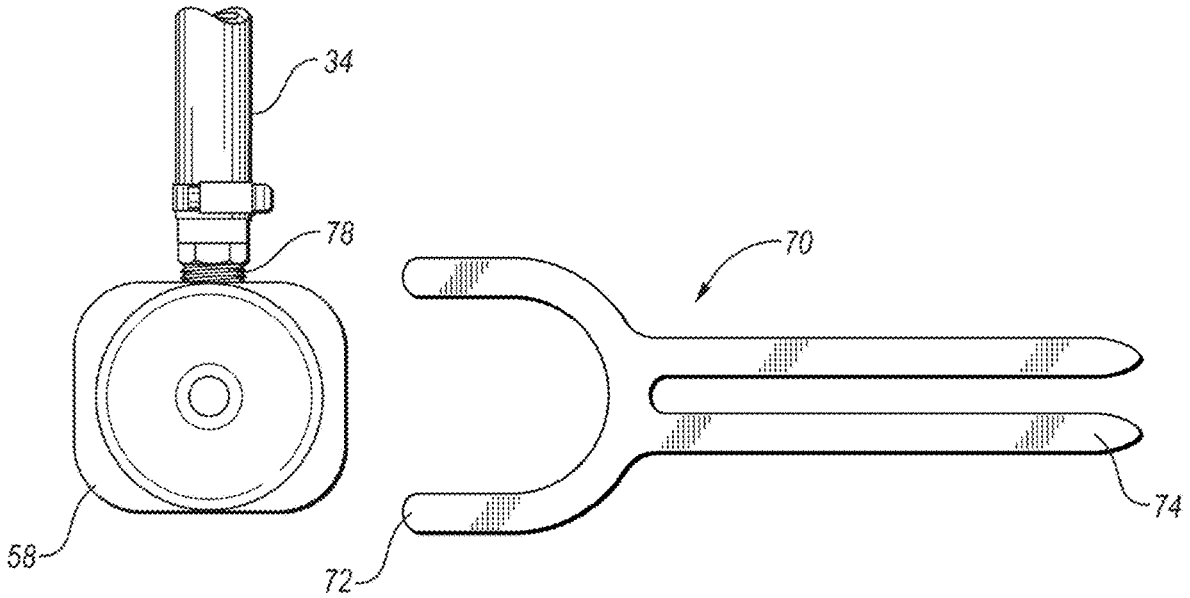
FIG. 5 is an overhead view of a universal adapter and head support of the engine valve cleaning system, according to one embodiment.

While the head support 70 is illustrated in FIG. 5 as having a second forked portion 74, in other embodiments the second end of the head support 70 is closed, such as in FIG. 4. In other words, the first forked portion 72 may be the only part of the head support that is open at its end, for sliding into engagement with the adapter 58. Meanwhile, the head support may be closed at its second end.

Instead, the adapter 58 is provided with an outlet 78 for the carbon deposits and/or the abrasive media 22. In particular, the outlet 78 may extend (e.g., perpendicular) from the tubular portion 66. The outlet 78 has an aperture extending therethrough in a direction of a length of the outlet 78 (e.g., perpendicular to the tubular portion 66). The outlet 78 provides a designated passage for the carbon deposits and/or the abrasive media 22 during cleaning of the engine head; as the pressurized air and optional abrasive media 22 are delivered into the engine head, the air along with the abrasive media and any carbon deposits are forced through the outlet 78.

The third tube 34 is coupled to the outlet 78. This provides a passageway for the pressurized air, abrasive media, and/or carbon deposits to travel therethrough, and into the second tank 20. The second tank 20 may have a separator (explained further below) to store and contain the abrasive media and carbon deposits while letting the pressurized air escape into the atmosphere.

Figure 8:
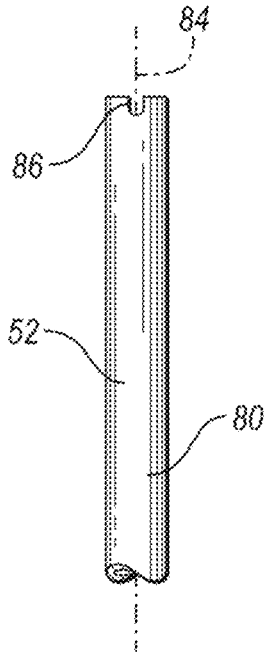
FIG. 8 is an overhead view of a tip of the spray applicator, according to one embodiment.

FIG. 8 illustrates a tip of the nozzle 52 of the spray applicator 30. The nozzle 52 includes an elongated tube 80 that may define at least a portion of a third passageway 82 (FIG. 3) within the spray applicator 30. The nozzle 52 may be an integral extension of the spray applicator 30, or may be separately connected to the spray applicator 30. The nozzle 52 is configured to deliver the pressurized air and abrasive media 22 from the third passageway 82 of the spray applicator 30. The elongated tube 80 extends along an axis 84. In one embodiment, the tip of the elongated tube 80 includes an outlet 86, which can be an aperture, groove, or the like. The outlet 86 can be formed by removing material from the tip of the tube 80. The outlet 86 may extend through one or more locations of the tube 80 in a direction perpendicular to the axis 84. This allows the pressurized air and abrasive media 22 to spray out of the nozzle in various directions, for example, in the direction of the axis 84 and in a direction perpendicular to the axis 84. This feature helps the spray applicator 30 reach various angles and surfaces within the engine head that may be unreachable with a single direction of spray from the nozzle, due to space constraints.

Figure 9:
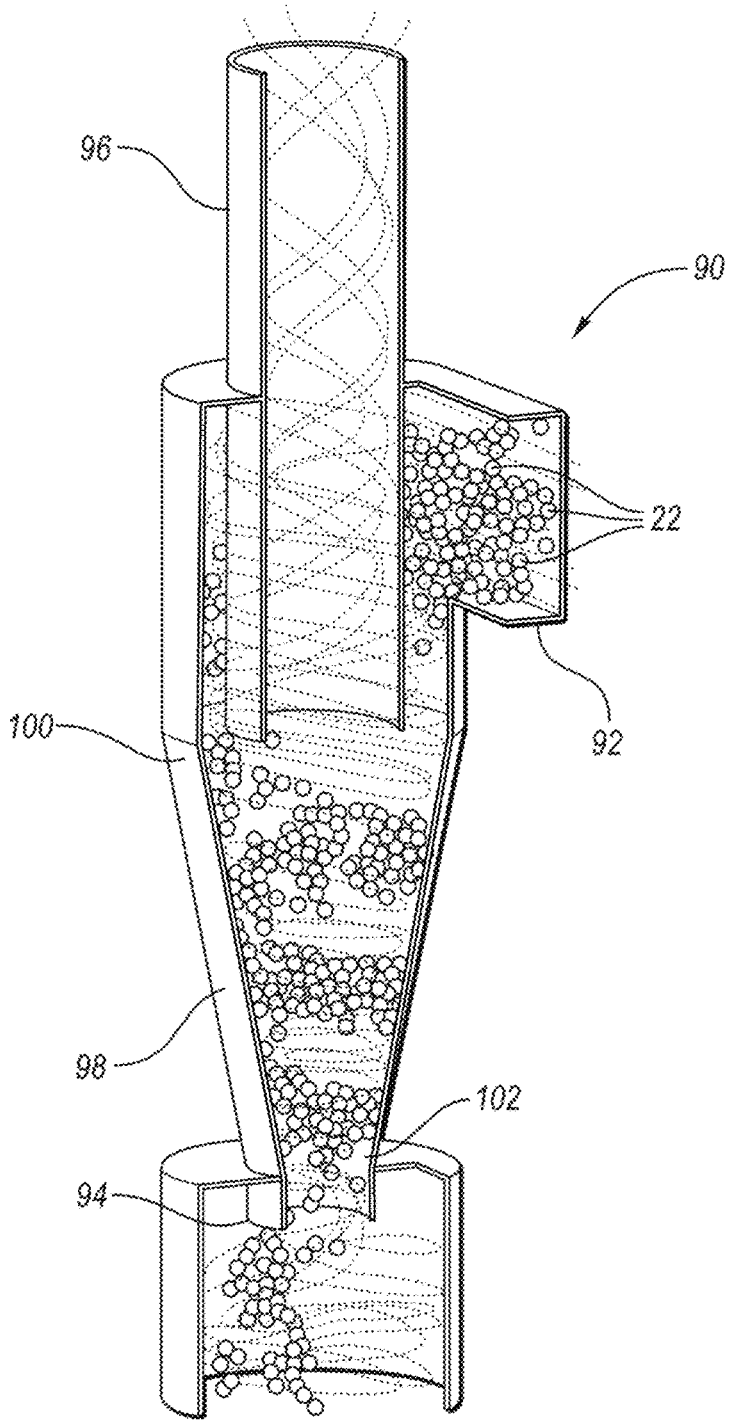
FIG. 9 is a cross-sectional perspective view of a portion of a cyclone particle separator of the engine valve cleaning system, according to an embodiment.

FIG. 9 illustrates a cross-sectional view of a particle separator 90. The particle separator is located at or coupled with the second tank 20, and is configured to separate or remove the carbon deposits and abrasive media 22 from the air, allowing the air to escape while holding the carbon deposits and abrasive media after cleaning the engine. In one embodiment, the particle separator 90 has an inlet 92 in which the air, abrasive media 22, and carbon deposits from cleaning the engine enter. The inlet 92 can be attached to the third tube 34 for transferring the material and air from the adapter 58 to the particle separator 90.

The particle separator 90 also has a first outlet 94 and a second outlet 96. The first outlet 94 is configured to deposit the carbon deposits and abrasive media into the second tank 20 for storage. Air may also travel into the second tank 20, but is allowed to exit the second tank 20 and particle separator 90 via the second outlet without the abrasive media and carbon deposits. In particular, the particle separator 90 includes a cone-shaped or partially-cone-shaped wall, hereinafter referred to as a frustoconical wall 98. The frustoconical wall 98 has a wider end 100 toward the second outlet 96, and aligned therewith. The frustoconical wall 98 has a narrower end 102 toward the first outlet 94, and aligned therewith. This creates a cyclone or swirling effect with the air, abrasive media and any carbon deposits therein. A centrifugal force created by the frustoconical wall 98 spins any abrasive media and carbon deposits out of the air stream, trapping the solid media and deposits in the second tank 20 below. In particular, the reducing diameter of the frustoconical wall 98 in the direction toward the second tank 20 increases the speed of the abrasive media and carbon deposits and forces them to contact and shock against the wall 98; heavier particles go down into the second tank 20 via gravity while the air is allows to exit upward through the center of the particle separator 90 and through the second outlet 96 above. In short, the dirty air with particles spins downward in a cyclonic manner against the surface of the wall 98 forcing the particles to enter the second tank 20, while the clean air spins upwards through the center of the cyclone and out the second outlet 96.

While not illustrated, in another embodiment the third tube 34 is connected directly to the second tank 20, without the use of a particle separator 90. The second tank 20 can have a filter (e.g., screen) that is sized to allow air to exit the second tank 20, but not the abrasive media and carbon deposits. This is another method of entrapping the abrasive media and carbon deposits in the second tank.

Figure 10:
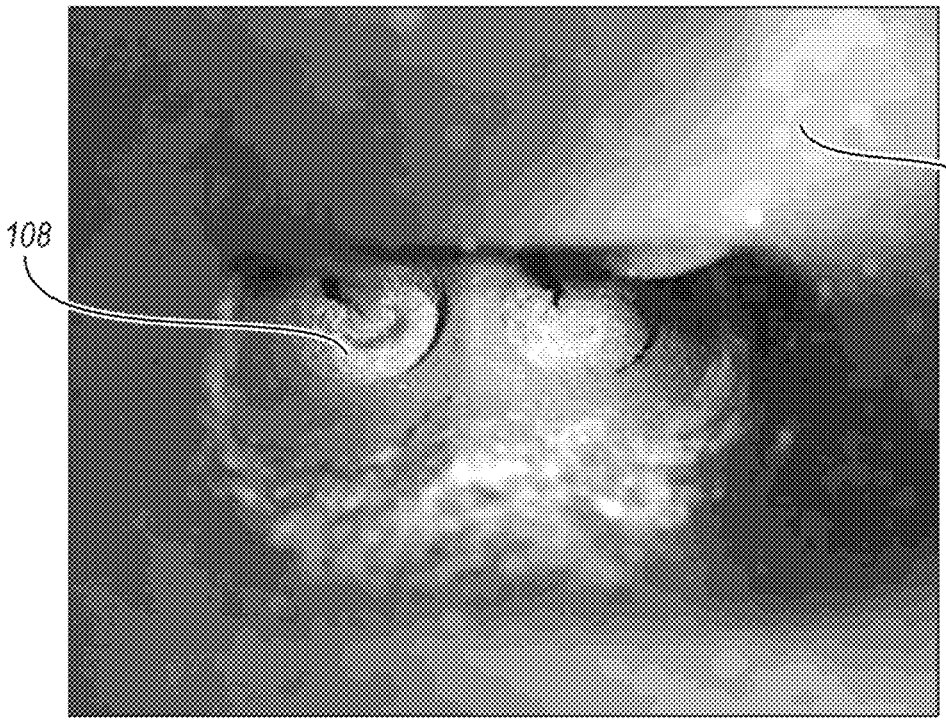
FIG. 10 is an interior view of an engine head showing an intake valve with carbon and soot deposits prior to use of the engine valve cleaning system.

FIG. 10 illustrates an engine head 106 with one or more valves 108 (e.g., intake valve) prior to cleaning. Carbon deposits and buildup is seen along the side walls of the engine head 106, and on the top surface of the valve 108. This can interfere with the operation of the engine if not properly cleaned.

Figure 11:
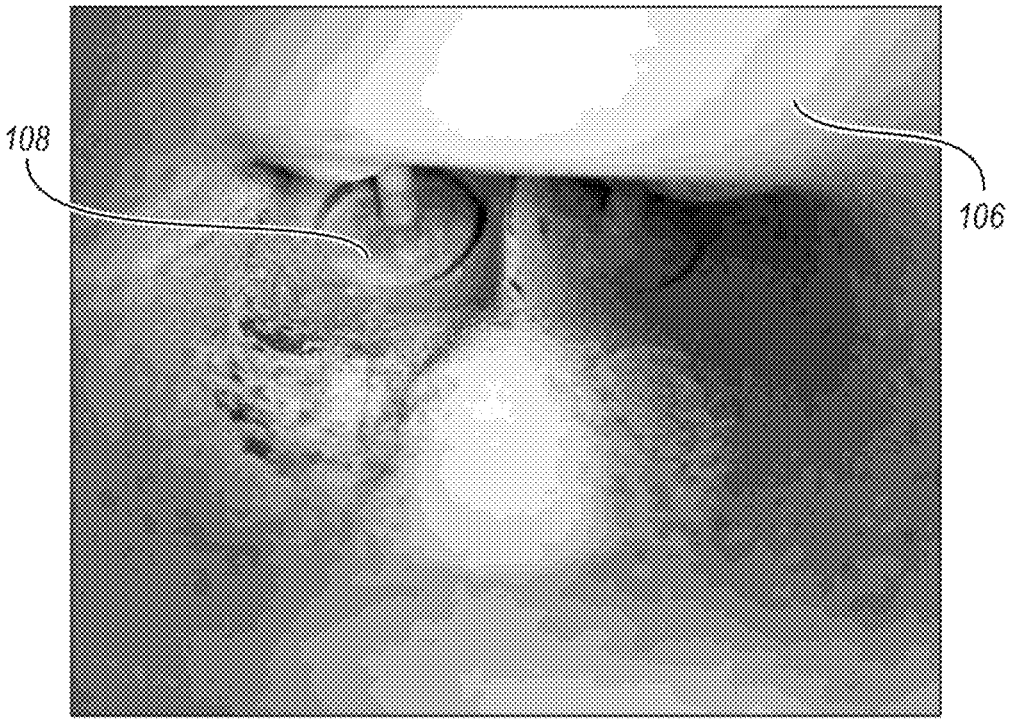
FIG. 11 is an interior of the engine head showing the intake valve after use of the engine valve cleaning system, showing the carbon and soot deposits removed.

FIG. 11 illustrates the engine head 106 and valve 108 after cleaning with the engine valve cleaning system. This Figure shows results after five minutes of cleaning. The carbon deposits are removed from the walls of the engine head 106, and from the upper surface of the valve 108.

While the disclosure above generally refers to utilizing the engine valve cleaning system 10 for components within an engine head, such as valves, it should be understood that the engine valve cleaning system 10 can be utilized in other applications where removal of carbon deposits in small places may be desirable. For example, the system 10 can be utilized on exhaust systems and the like where inserting the spray applicator into tight spaces may be required.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. An engine valve cleaning system, comprising:

a first tube configured to deliver pressurized air;

a second tube configured couple to an abrasive media source and draw an abrasive media therefrom; and a spray applicator including:

a first passageway coupled to the first tube and configured to deliver pressurized air, a second passageway coupled to the second tube and configured to deliver the abrasive media, wherein the first passageway intersects the second passageway such that a passing of the pressurized air past the second passageway is configured to draw the abrasive media from the abrasive media source, and a third passageway downstream of the first and second passageways and configured to output the pressurized air and abrasive media to an engine.

2. The engine valve cleaning system of claim 1, wherein the first passageway includes a first portion having a first diameter, and a second portion having a second diameter smaller than the first diameter.

3. The engine valve cleaning system of claim 2, wherein the second diameter is less than half of the first diameter.

4. The engine valve cleaning system of claim 2, wherein a venturi effect is created upon the passing of the pressurized air past the second passageway, wherein the venturi effect draws the abrasive media from the abrasive media source.

5. The engine valve cleaning system of claim 2, wherein the third passageway has a third diameter that exceeds the second diameter.

6. The engine valve cleaning system of claim 1, further comprising a valve configured to selectively block the abrasive media from entering the third passageway.

7. The engine valve cleaning system of claim 1, wherein the spray applicator further includes a nozzle that includes an elongated tube coupled to the third passageway and configured to deliver the pressurized air and abrasive media to the engine, wherein the elongated tube extends along an axis and includes an outlet extending perpendicular to the axis.

8. The engine valve cleaning system of claim 1, wherein:

the spray applicator further includes a nozzle, the engine valve cleaning system further includes an adapter configured to attach over an opening in an engine head, and the adapter has an aperture extending therethrough and sized to receive the nozzle and aligned with the opening in the engine head to enable the nozzle to extend through the aperture in the adapter and into the opening in the engine head.

9. The engine valve cleaning system of claim 8, wherein:

the adapter includes a second aperture extending therethrough, the engine valve cleaning system further includes a third tube attached to the adapter at the second aperture and configured to receive pressurized air and carbon deposits from within the engine head after applying the pressurized air to the engine head.

10. The engine valve cleaning system of claim 9, further comprising a cyclone particle separator connected to the third tube, wherein the cyclone particle separator includes a cone-shaped portion having a narrowed end and a widened end, wherein the narrowed end is coupled to a tank and configured to deliver the carbon deposits to the tank, and wherein the widened end is coupled to an outlet configured to release the pressurized air.

11. An engine valve cleaning system comprising:

a first tank containing an abrasive media;

a first tube having a first end connected to the first tank, and a second end connected to a spray applicator;

a second tube connected to the spray applicator and configured to supply pressurized air to the spray applicator;

a universal adapter configured to connect to an opening of an engine head, the universal adapter having:

an inlet extending therethrough and configured to receive the spray applicator for spraying the pressurized air and abrasive media into the engine head, and an outlet configured to outlet the pressurized air and the abrasive media subsequent to the spraying of the pressurized air and abrasive media; and a third tube connected to the outlet of the universal adapter and configured to deliver the pressurized air and abrasive media output from the outlet into a second tank.

12. The engine valve cleaning system of claim 11, wherein the second tank includes a cyclone particle separator having an inlet configured to receive the pressurized and air abrasive media from the third tube, and an outlet configured to release the pressurized air but not the abrasive media.

13. The engine valve cleaning system of claim 12, wherein the cyclone particle separator includes a frustoconical portion having a narrowed end facing toward a bottom of the second tank, and a widened end facing a top of the second tank, wherein the frustoconical portion, when provided with the pressurized air from the third tube, creates a swirling effect on the pressurized air to force the abrasive media toward the narrowed end of the frustoconical portion.

14. The engine valve cleaning system of claim 11, wherein the spray applicator includes a first passageway coupled to the first tube, and a second passageway coupled to the second tube, wherein the first and second passageways intersect within the spray applicator.

15. The engine valve cleaning system of claim 14, wherein the first passageway intersects the second passageway such that a passing of the pressurized air past the second passageway is configured to draw the abrasive media from a source of the abrasive media.

16. The engine valve cleaning system of claim 15, wherein the first passageway includes a first portion having a first diameter, and a second portion having a second diameter smaller than the first diameter, and wherein a venturi effect is created upon the passing of the pressurized air through the second diameter and past the second passageway, wherein the venturi effect draws the abrasive media from the abrasive media source.

17. A method of removing carbon deposits from surfaces of an engine head, the method comprising:

placing an adapter above an opening of an engine head;

inserting a spray gun into a first opening of the adapter and into the engine head; and activating a spray applicator to cause pressurized air and an abrasive media to spray onto surfaces within the engine head, wherein the pressurized air and abrasive media exits the adapter via a second opening of the adapter and into a tank.

18. The method of claim 17, further comprising separating the abrasive media from the pressurized air within in the tank.

19. The method of claim 18, wherein the separating is performed via a cyclone particle separator including a frustoconical portion having a narrowed end facing toward a bottom of the tank, and a widened end facing a top of the tank.

20. The method of claim 19, wherein the separating is further performed via an outlet extending upward from a center axis of the frustoconical portion to enable the pressurized air without the abrasive media to exit the tank.

* * * * *